US009759055B2

(12) United States Patent
Harfoushian

(10) Patent No.: US 9,759,055 B2
(45) Date of Patent: Sep. 12, 2017

(54) FORMATION FRACTURING AND SAMPLING METHODS

(71) Applicant: Schlumberger Technology Corporation, Sugar Land, TX (US)

(72) Inventor: Hagop Jack Harfoushian, Perth (AU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 240 days.

(21) Appl. No.: 14/571,520

(22) Filed: Dec. 16, 2014

(65) Prior Publication Data

US 2015/0167442 A1 Jun. 18, 2015

Related U.S. Application Data

(60) Provisional application No. 61/917,494, filed on Dec. 18, 2013.

(51) Int. Cl.

| | |
|---|---|
| ***E21B 43/26*** | (2006.01) |
| ***E21B 49/02*** | (2006.01) |
| ***E21B 43/267*** | (2006.01) |
| ***E21B 49/08*** | (2006.01) |

(52) U.S. Cl.

CPC ..... *E21B 43/267* (2013.01); *E21B 49/082* (2013.01)

(58) Field of Classification Search

CPC ..... E21B 43/162; E21B 43/26; E21B 49/02; E21B 49/08; E21B 49/081; E21B 49/082; E21B 49/10

USPC .... 166/264, 280.1, 308.1, 305.1, 177.5, 267

See application file for complete search history.

(56) References Cited

U.S. PATENT DOCUMENTS

| | | | | |
|---|---|---|---|---|
| 7,614,294 | B2 * | 11/2009 | Hegeman | E21B 43/25 73/152.39 |
| 7,757,769 | B2 * | 7/2010 | Hill | E21B 27/02 166/100 |
| 8,015,869 | B2 * | 9/2011 | Nold, III | E21B 49/008 73/152.51 |
| 8,283,174 | B2 * | 10/2012 | Van Hal | E21B 36/008 166/250.1 |
| 8,397,817 | B2 * | 3/2013 | Edwards | E21B 43/26 166/100 |
| 8,561,698 | B2 | 10/2013 | Harrigan et al. | |
| 8,622,128 | B2 * | 1/2014 | Hegeman | E21B 47/10 166/250.01 |
| 9,051,822 | B2 * | 6/2015 | Ayan | E21B 43/16 |

(Continued)

OTHER PUBLICATIONS

Carnegie, A., Thomas, M., Efnik, M.S. et al. 2000. An Advanced Method of Determining Insitu Reservoir Stresses: Wireline Conveyed Micro-Fracturing. Paper SPE 78486 presented at 10th Abu Dhabi International Petroleum Exhibition and Conference.

(Continued)

*Primary Examiner* — Kenneth L Thompson
(74) *Attorney, Agent, or Firm* — Michael Dae

(57) ABSTRACT

The present disclosure relates to a method of fracturing and sampling an isolated interval within a wellbore. The method includes deploying a plurality of packers to isolate the interval and initiating a fracture at the isolated interval. The method further includes directing a motive fluid into a proppant injection chamber to direct a proppant stored within the proppant injection chamber into the isolated interval. Sampling also may be performed at the isolated interval.

6 Claims, 4 Drawing Sheets

(56) References Cited

U.S. PATENT DOCUMENTS

| | | | | |
|---|---|---|---|---|
| 9,062,544 | B2 * | 6/2015 | Landsiedel | E21B 33/1243 |
| 9,477,002 | B2 * | 10/2016 | Miller | E21B 33/124 |
| 2008/0006407 | A1 | 1/2008 | Lehr et al. | |
| 2010/0157737 | A1 | 6/2010 | Miller et al. | |
| 2011/0303409 | A1 * | 12/2011 | Harrigan | E21B 49/08 166/264 |

OTHER PUBLICATIONS

Desroches, J., Kurkjian, A.L.1998. Applications of Wireline Stress Measurement. Paper SPE 58086, SPE Reservoir Eval. & Eng., vol. 2, No. 5, Oct. 1999, pp. 451-461.

Harfoushian, J., Pourabed, H., Moh, H.W. et al. 2013. A Novel Approach for Efficiently Evaluating Extended Intervals in Coalbed Methane Reservoirs. Paper SPE 166088 prepared for presentation at the Annual Technical Conference and Exhibition, New Orleans, Louisiana, USA, Sep. 30-Oct. 2.

Examination Report issued in related AU application 2014277751 on Sep. 11, 2015, 6 pages.

* cited by examiner

FORMATION FRACTURING AND SAMPLING METHODS

CROSS-REFERENCE TO RELATED APPLICATIONS

This application claims benefit of U.S. Provisional Patent Application Ser. No. 61/917,494, filed Dec. 18, 2013, which is herein incorporated by reference.

BACKGROUND OF THE DISCLOSURE

Wellbores (also known as boreholes) are drilled to penetrate subterranean formations for hydrocarbon prospecting and production. During drilling operations, evaluations may be performed of the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation. These drilling tools and wireline tools, as well as other wellbore tools conveyed on coiled tubing, drill pipe, casing or other conveyers, are also referred to herein as "downhole tools."

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. To promote fluid communication for low permeability formations, the formation may be fractured prior to sampling.

SUMMARY

The present disclosure relates to a method that includes deploying packers to isolate an interval within a wellbore and initiating a fracture at the isolated interval. The method further includes directing a motive fluid into a proppant injection chamber to direct a proppant stored within the proppant injection chamber into the isolated interval.

The present disclosure also relates to a method that includes conveying a downhole tool within a wellbore, where the downhole tool has an injection module disposed between a first packer module and a second packer module. The method also includes deploying a first packer of the first packer module and a second packer of the second packer module to isolate an interval within the wellbore. The method further includes initiating a fracture at the isolated interval by directing a fracturing fluid into the isolated interval through a port in the second packer module. Moreover, the method includes injecting a proppant into the isolated interval by directing a motive fluid into a proppant injection chamber of the injection module to displace a piston and move the proppant into the isolated interval. The method also includes performing sampling of the isolated interval by directing formation fluid from the isolated interval into the downhole tool through the port in the second packer module.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to methods for fracturing and sampling formations. According to certain embodiments, an interval of a wellbore may be isolated using a pair of dual or single packer modules. An injection module, disposed on the tool string between the pair of packer modules, may be employed in conjunction with the packer modules to initiate a fracture at the isolated interval. The injection module also may be employed to inject proppant into the fracture. In certain embodiments, the proppant may be stored in a chamber of the injection module. The chamber includes a piston that hydraulically isolates the proppant from a motive fluid, such as mud, or other wellbore fluid, within the chamber. To inject the proppant, the pump may be operated to direct the motive fluid into the chamber and move the piston to direct the proppant into the wellbore. The injection module may further be employed to sample the fractured formation.

Figure 1:
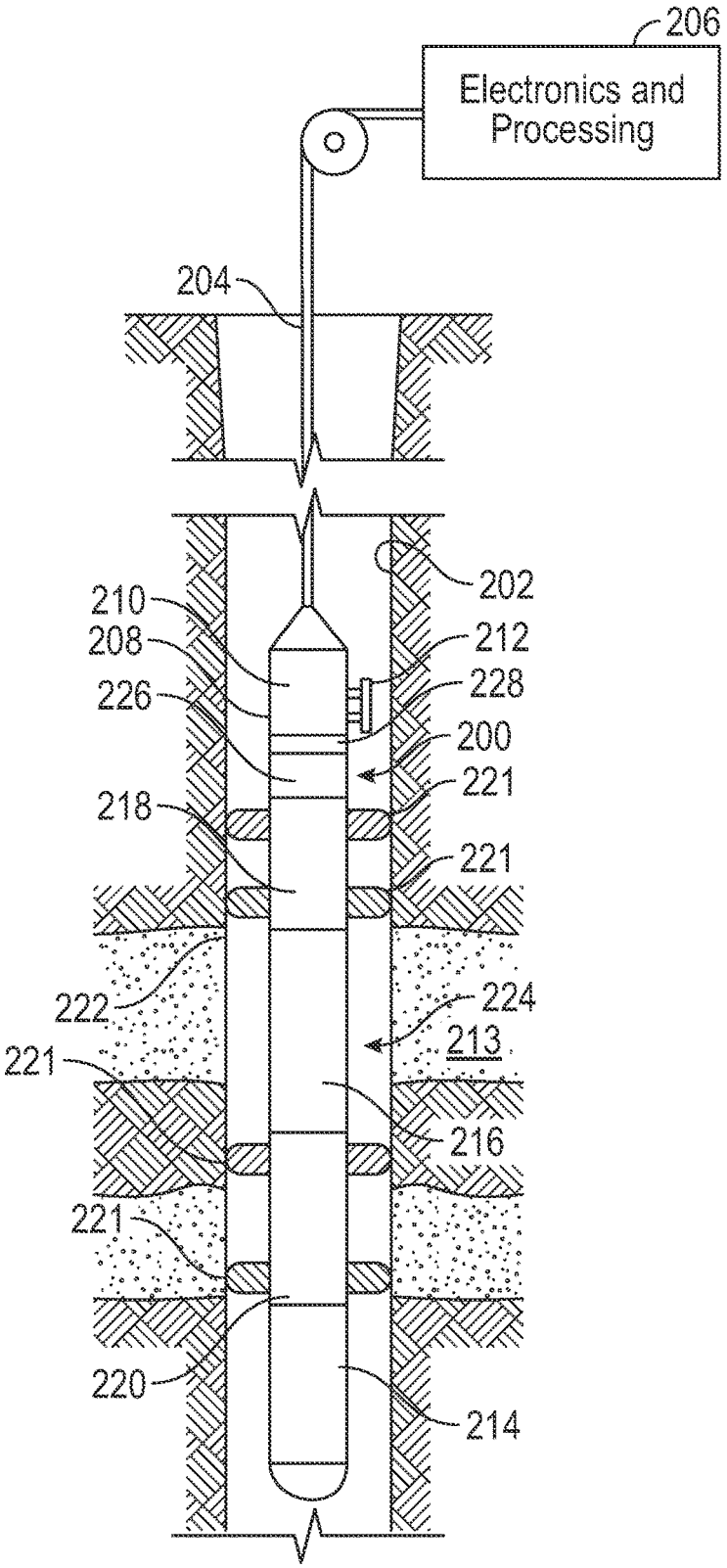
FIG. 1 is a schematic view of an embodiment of a wellsite system that may employ fracturing and sampling methods, according to aspects of the present disclosure.

FIG. 1 depicts an example of a wellsite system that may employ the fracturing and sampling techniques described herein. A downhole tool 200 is suspended in a wellbore 202 from the lower end of a multi-conductor cable 204 that is spooled on a winch at the surface. The cable 204 is communicatively coupled to an electronics and processing system 206. The downhole tool 200 includes an elongated body 208 that houses modules 210, 214, 216, 218, 220, 226, and 228 that provide various functionalities including fluid sampling, fluid testing, wellbore isolation, and operational control, among others. The modules may represent independent sections of the downhole tool 200 that can be mechanically coupled together, for example, by pin and box connections or other suitable couplings, to provide electrical communication and fluid communication between the modules. As shown in FIG. 1, the downhole tool 200 is conveyed on a wireline (e.g., using the multi-conductor cable 204); however, in other embodiments the downhole tool may be conveyed on a drill string, coiled tubing, wired drill pipe, or other suitable types of conveyance.

As shown in FIG. 1, the module 210 is a fluid communication module 210 that has a selectively extendable probe 212 that can engage the wall 222 of the wellbore to draw fluid samples from the formation 213. The probe 212 may include a single inlet or multiple inlets designed for guarded or focused sampling. The formation fluid may be expelled to the wellbore through a port in the body 208 or the formation fluid may be sent to a fluid sampling module 214. The fluid sampling module 214 may include one or more sample chambers that store the formation fluid.

Formation fluid also may be directed into the downhole tool 200 using the injection module 216. The injection module 216 is disposed on the downhole tool 200 between a pair of packer modules 218 and 220. The packer modules 218 and 220 each include a pair of packers that can be expanded to engage the wall 222 of the wellbore 202 and isolate an interval 224 of the wellbore 202. The isolated interval 224 extends within the wellbore 202 between the packer modules 218 and 220, and the injection module 216 is disposed within the isolated interval 224. As described further below with respect to FIG. 3, the injection module 216 may be employed in conjunction with the packer modules 218 and 220 to fracture the formation 213 at the isolated interval 224 and sample formation fluid.

The downhole tool 200 also includes a pump out module 226 that can be employed to direct fluids through the downhole tool 200, as well as a fluid analysis module 228 that can be employed to determine properties of the formation fluid. Further, in other embodiments, additional modules may be included in the downhole tool 200 to provide further functionality, such as resistivity measurements, communications, coring, and/or imaging, among others. In the illustrated example, the electronics and processing system 206 and a downhole control system are configured to control operation of the modules.

Figure 2:
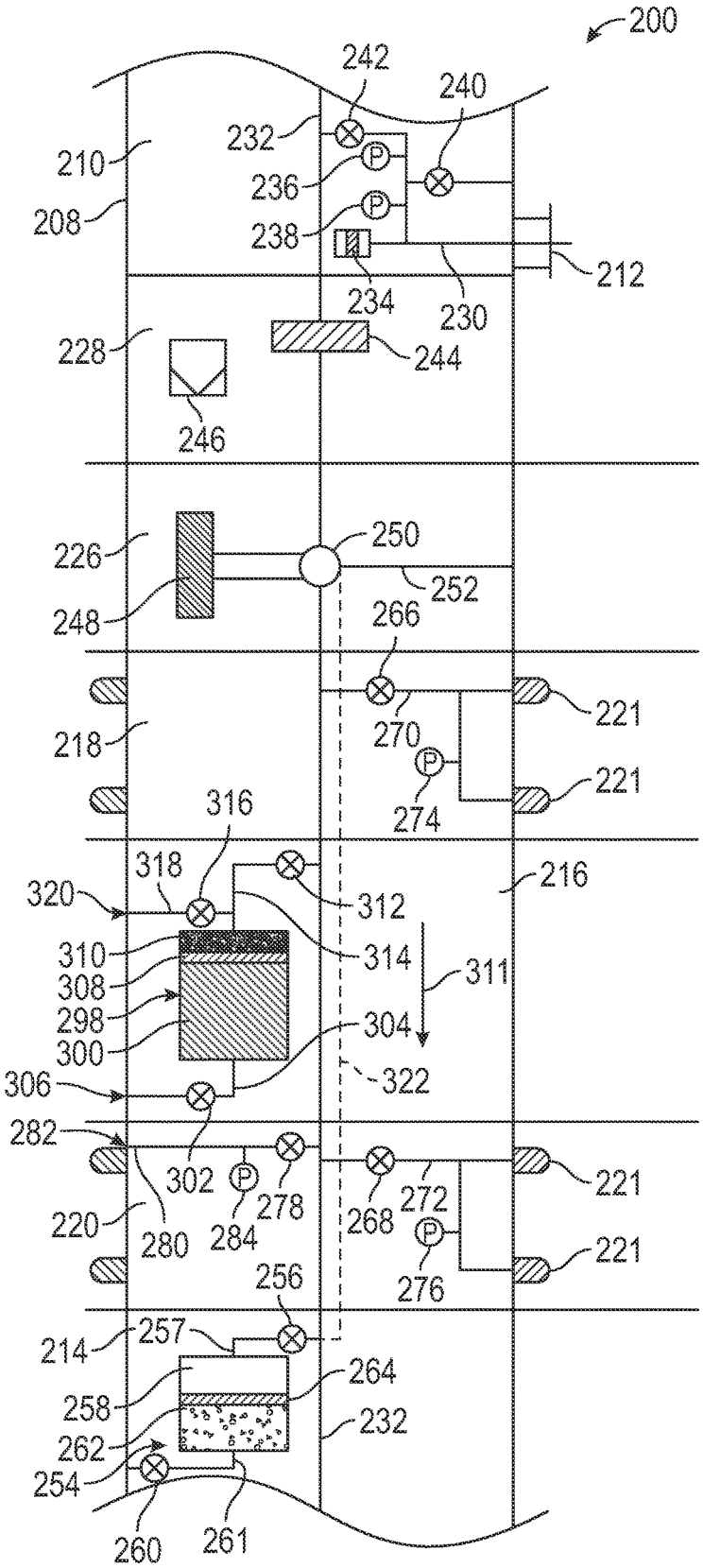
FIG. 2 is a schematic representation of a portion of the downhole tool of FIG. 1, according to aspects of the present disclosure.

FIG. 2 is a schematic diagram of a portion of the downhole tool 200 depicting internal fluid flow through the tool. The fluid communication module 210 includes the probe 212 for directing formation fluid into the downhole tool 200. The fluid communication module 210 includes a probe flowline 230 that directs the fluid to a primary flowline 232 that extends through the downhole tool 200. The fluid communication module 210 also includes a pump 234 and pressure gauges 236 and 238 that may be employed to conduct formation pressure tests. An equalization valve 240 may be opened to expose the flowline 230 to the pressure in the wellbore, which in turn may equalize the pressure within the downhole tool 200. Further, an isolation valve 242 may be closed to isolate the formation fluid within the flowline 230, and may be opened to direct the formation fluid from the probe flowline 230 to the primary flowline 232.

The primary flowline 232 directs the formation fluid through the downhole tool to the fluid analysis module 228 that includes a fluid analyzer 244, which can be employed to provide in situ downhole fluid measurements. For example, the fluid analyzer 244 may include an optical spectrometer and/or a gas analyzer designed to measure properties such as, optical density, fluid density, fluid viscosity, fluid fluorescence, fluid composition, oil based mud (OBM), and the fluid gas oil ratio (GOR), among others. One or more additional measurement devices, such as temperature sensors, pressure sensors, resistivity sensors, chemical sensors (e.g., for measuring pH or $H_2S$ levels), and gas chromatographs, may also be included within the fluid analyzer 244. In certain embodiments, the fluid analysis module 228 may include a controller 246, such as a microprocessor or control circuitry, designed to calculate certain fluid properties based on the sensor measurements. Further, in certain embodiments, the controller 246 may govern the fracturing and sampling operations. Moreover, in other embodiments, the controller 246 may be disposed within another module of the downhole tool 200.

The downhole tool 200 also includes the pump out module 226, which includes a pump 248 designed to provide motive force to direct the fluid through the downhole tool 200. According to certain embodiments, the pump 248 may be a hydraulic displacement unit that receives fluid into alternating pump chambers. A valve block 250 may direct the fluid into and out of the alternating pump chambers. The valve block 250 also may direct the fluid exiting the pump 248 through the primary flowline 232 or may divert the fluid to the wellbore through an exit flowline 252.

The downhole tool 200 also includes the sample module 214 designed to store a sample of the formation fluid within a sample chamber 254. As shown in FIG. 2, a single sample chamber 254 is included within the sample module 214. However, in other embodiments, multiple sample chambers may be included within the sample module 214 to provide for storage of multiple formation fluid samples. Further, in other embodiments, multiple sample modules 214 may be included within the downhole tool. Moreover, other types of sample chambers, such as single phase sample bottles, among others, may be employed in the sample module 214.

The sample chamber 254 includes a floating piston 264 that divides the sample chamber into two volumes 258 and 262. As the formation fluid flows through the primary flowline 232, a valve 256 may be actuated to divert the formation fluid through a sample flowline 257 and into the volume 258. In certain embodiments, the pump 248 may provide the motive force to direct the fluid through the primary flowline 232 and into the sample chamber 254. The formation fluid may be stored within the volume 258 and, in certain embodiments, may be brought to the surface for further analysis. The sample module 214 also may include a valve 260 that can be opened to expose the volume 262 of the sample chamber 254 to the annular pressure. In certain embodiments, the valve 260 may be opened to allow buffer fluid to exit the volume 262 to the wellbore, which may provide backpressure during filling of the volume 258 that receives formation fluid.

Formation fluid also may be drawn into the downhole tool 200 using the injection module 216 and the dual packer modules 218 and 220. Each dual packer module 218 and 220 includes a respective valve 266 or 268 that can be actuated to divert fluid from the primary flowline 232 into the packers 221. For example, mud from the wellbore, or other suitable fluid, may be directed through the primary flowline 232 and diverted to inflation lines 270 and 272 through the valves 266 and 268 to inflate the packers 221. Pressure gauges 274 and 276 may be disposed in the respective inflation lines 270 and 272 to monitor the pressure and/or to ensure a sufficient seal between the packers 221 and the wellbore wall.

Once the packers 221 have been inflated to seal the interval 224 (FIG. 1), formation fluid may be drawn into the downhole tool 200 from the interval 224. For example, the packer module 220 includes an interval valve 278 that may be actuated to direct fluid from the wellbore into a flowline 280 through a port 282 in the body 208 of the downhole tool 200. As shown in FIG. 2, the port 282 is disposed on the packer module 220 between the packers 221 and the injection module 216. However, in other embodiments, the port 282 may be disposed in the injection module 216 or in the packer module 218, for example between the packers 221 and the injection module 216. The pump 248 may be operated to draw fluid through the flowline 280, to the primary flowline 232 where the fluid may be directed to the volume 258 through the sample flowline 257. A pressure gauge 284 also may be disposed in the flowline 280 for pressure testing, as discussed further below with respect to FIG. 3.

To facilitate sampling from the interval 224 (FIG. 1), the injection module 216 may be employed to promote flow of fluid within the formation by maintaining or re-opening a fracture. The injection module 216 is disposed between the two packer modules 218 and 220 to allow fracturing and sampling from the interval 224 without moving the downhole tool 200 within the wellbore. For example, the packer modules 218 and 220 may be employed to isolate the interval 224. Then, a fracture may be initiated at the interval, for example, using the packer module 220, as discussed further below with respect to FIG. 3. Proppant may then be injected into the interval 224 by the injection module 216 to maintain and/or open the fracture. A formation sample may then be obtained from the interval 224.

Figure 3:
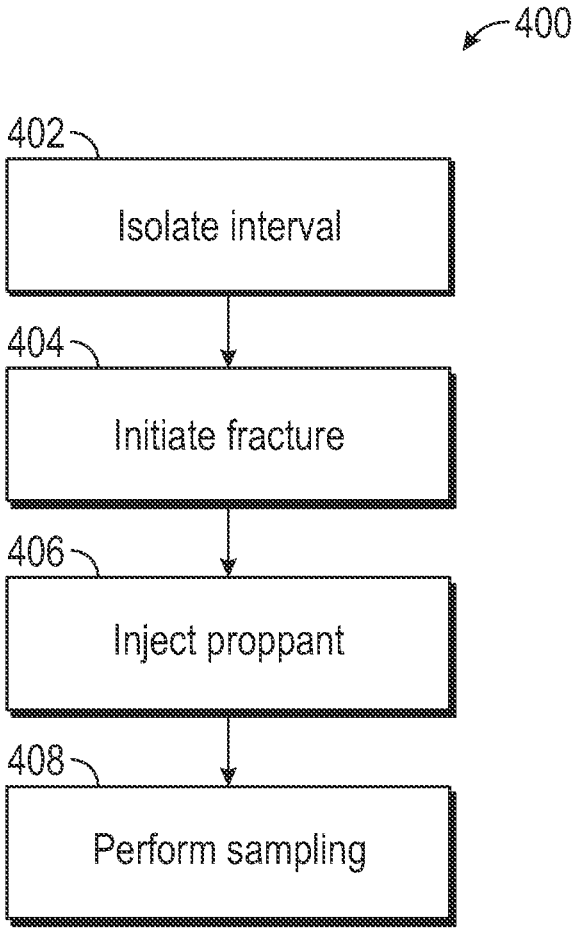
FIG. 3 is a flowchart depicting an embodiment of a method for fracturing and sampling, according to aspects of the present disclosure.

The injection module 216 includes a proppant injection chamber 298 that stores proppant within a volume 300. A flowline 304 is fluidly coupled to the volume 300 and a valve 302 may be actuated to allow proppant to flow into and out of the volume 300 through a port 306 in the body 208 of the downhole tool 200. The chamber 298 also includes a floating piston 308 that divides the chamber 298 into the volume 300 and another volume 310. The volume 310 may receive a motive fluid, such as mud or wellbore fluid, that moves the floating piston 308 in the direction of the arrow 311 to inject the proppant into the wellbore. In certain embodiments, the pump 248 may be employed to move the motive fluid through the primary flowline 232 and into the motive fluid line 314 to the volume 310. Although a single proppant injection chamber 298 is shown in FIG. 3, in other embodiments, multiple proppant injection chambers may be included within the injection module 216. Moreover, in certain embodiments, multiple injection modules 216 may be included in the downhole tool between the packer modules.

According to certain embodiments, the volume 300 may be filled with proppant while the downhole tool 200 is positioned at the surface. For example, the valve 302 may be opened and proppant may be directed into the volume 300 through the port 306 and the flowline 304. As the volume 300 is filled, the piston 310 may move upward (e.g., in the direction opposite to arrow 311) and motive fluid present within the volume 310 may be directed through the motive fluid line 314. The valve 312 within the motive fluid line 314 may be closed during the filling process, while a valve 316 disposed in a drain line 318 may be opened, allowing the motive fluid expelled from the volume 310 to exit the downhole tool 200 through a port 320. After the volume 300 has been filled with proppant, the valves 302 and 316 may be closed to retain the proppant within the volume 300 while the downhole tool 200 is conveyed within the wellbore. Further, in certain embodiments, the valve 302 may remain open, while the valve 316 may be closed to retain the proppant within the volume 300.

FIG. 3 is a flowchart depicting an embodiment of a method 400 that may be employed to fracture and sample an isolated interval. According to certain embodiments, the method 400 may be executed, in whole or in part, by the controller 246 (FIG. 2). For example, the controller 246 may execute code stored within circuitry of the controller 246, or within a separate memory or other tangible readable medium, to perform the method 400. Further, in certain embodiments, the controller 246 may operate in conjunction with a surface controller, such as the processing system 206 (FIG. 1), that may perform one or more operations of the method 400.

The method 400 may begin by isolating (block 402) an interval within a wellbore. For example, the downhole tool 200 may be conveyed within a wellbore 202 to a desired location, as shown in FIG. 1. The packers 221 may then be inflated to isolate an interval 224 that extends within the wellbore 202 between the packers 221. For example, as shown in FIG. 2, mud or other fluid may be directed into the packers 221 through the inflation lines 270 and 272. Further, in other embodiments, the packers may be expanded rather than inflated, for example, by actuating a mechanical expansion mechanism. According to certain embodiments, the sealing integrity of the packers 221 may then be verified by performing a pressure test. For example, the pump 248 may be operated to draw fluid from the wellbore into the downhole tool through the port 282. The pump 248 may then be stopped and the pressure response in the wellbore may be measured, for example using the pressure gauge 284.

After the interval has been isolated, the method may continue by initiating (block 404) a fracture at the interval. For example, as shown in FIG. 2, wellbore fluids, such as mud, may be injected into the interval 224 through the port 282 in the packer module 220. The fluids may cause the pressure in the interval 224 to increase, thereby producing pressure sufficient to fracture the formation. In certain embodiments, the pump 248 may be operated to draw wellbore fluids into the primary flowline 232, for example through another port in the downhole tool above or below the interval 224, and the valve 278 may be opened to direct the fluids out of the port 282 and into the interval 224. For example, in certain embodiments, wellbore fluids may be drawn into the primary flowline 232 through the exit flowline 252. The pump 248 may then be stopped and, in certain embodiments, the fracture may close.

Proppant may then be injected (block 406) into the interval to re-open, or maintain, the fracture. For example, as shown in FIG. 2, the valve 278 for the port 282 in the packer module 220 may be closed. The valve 302 in the injection module 216 may be opened, or maintained in the open state if already open, to allow proppant to enter the wellbore through the port 306. Further, the valve 316 may be closed, or maintained in the closed state if already closed, to prevent motive fluid from exiting the downhole tool 200 through the port 320. According to certain embodiments, the valves 302 and 316 may be manual valves, and in these embodiments, the valves 302 and 316 may be set to the open and closed positions, respectively, at the surface prior to conveying the downhole tool 200 into the wellbore 202. However, in other embodiments, the valves 316 and 302 may be controllable valves, such as motor driven valves or solenoid valves, among others, that may be actuated by the controller 246 or electronics and processing system 206 while the downhole tool 200 is disposed in the wellbore 202.

To inject the proppant from the chamber 298 into the interval 224, the valve 312 may be opened, for example by a control signal sent from the electronics and processing system 206 or the controller 246. The pump 248 also may be operated to direct motive fluid, such as wellbore fluid, into the volume 310. In particular, the pump 248 may direct the motive fluid through the primary flowline 232 and the motive fluid line 314 into the volume 310 to move the piston 308 in the direction of the arrow 311. The movement of the piston 308 may direct the proppant from the volume 300 through the flowline 304 and port 306 into the isolated interval 224. The piston 308 may allow the pump 248 to be used to inject the proppant (e.g., via the motive fluid), while the pump 248 is hydraulically isolated from the proppant. As the proppant enters the interval 224, the pressure within the interval 224 may increase, reopening and propagating the previously initiated fracture. Further, proppant from the interval 224 may be pushed into the fracture. After the proppant has been injected into the interval 224, the pump 248 may be stopped and the valve 312 may be closed.

According to certain embodiments, the pressure fall-off within the interval 224 may be measured, for example, using the pressure gauge 284 in the packer module 220, and used for pressure and permeability estimations. Further, in certain embodiments, the pump 248 may be employed to draw fluid from the interval 224 into the downhole tool 200. For example, the valve 278 may be opened and fluid from the interval 224 may be drawn into the downhole tool 200 through the port 282 and the flowline 280 in the packer module 220. The pump 248 may then be stopped and the pressure response in the wellbore may be measured, for example using the pressure gauge 284. The pressure response may be employed to determine the formation pressure and permeability of the interval 224.

Sampling may then be performed (block 408) at the interval 224. The placement of the injection module 216 between the packer modules 218 and 220 allows sampling to be performed at the same location in the wellbore as fracturing, without moving the downhole tool 200 within the wellbore 202 between the fracturing and sampling processes. As shown in FIG. 2, fluid may be withdrawn into the downhole tool 200 through the port 282 in the packer module 220. The fluid may be directed through the valve 278 and flowline 280 to the primary flowline 232. The pump 248 may draw the fluid through the primary flowline 232 to the fluid analyzer 244 to determine properties of the fluid. Once the fluid exhibits desired properties, such as low contamination (e.g., a contamination level within a desired range), for example, the fluid may be routed to the sample chamber 254 where the fluid may be stored for retrieval to the surface.

As shown in FIG. 2, the sample chamber 254 is disposed below the packer module 220, and accordingly, in this embodiment, a secondary flowline 322 may be employed to route the sample fluid from the pump 248 to the sample chamber 254. However, in other embodiments, the position of the sample module 214 within the downhole tool 200 may vary. For example, the sample module 214 may be positioned above the pump out module 226. In these embodiments, the primary flowline 232 may be employed to direct the fluid to the sample chamber 254. Moreover, in certain embodiments, the respective positions of the modules 208, 214, 228, and 226 may vary.

Figure 4:
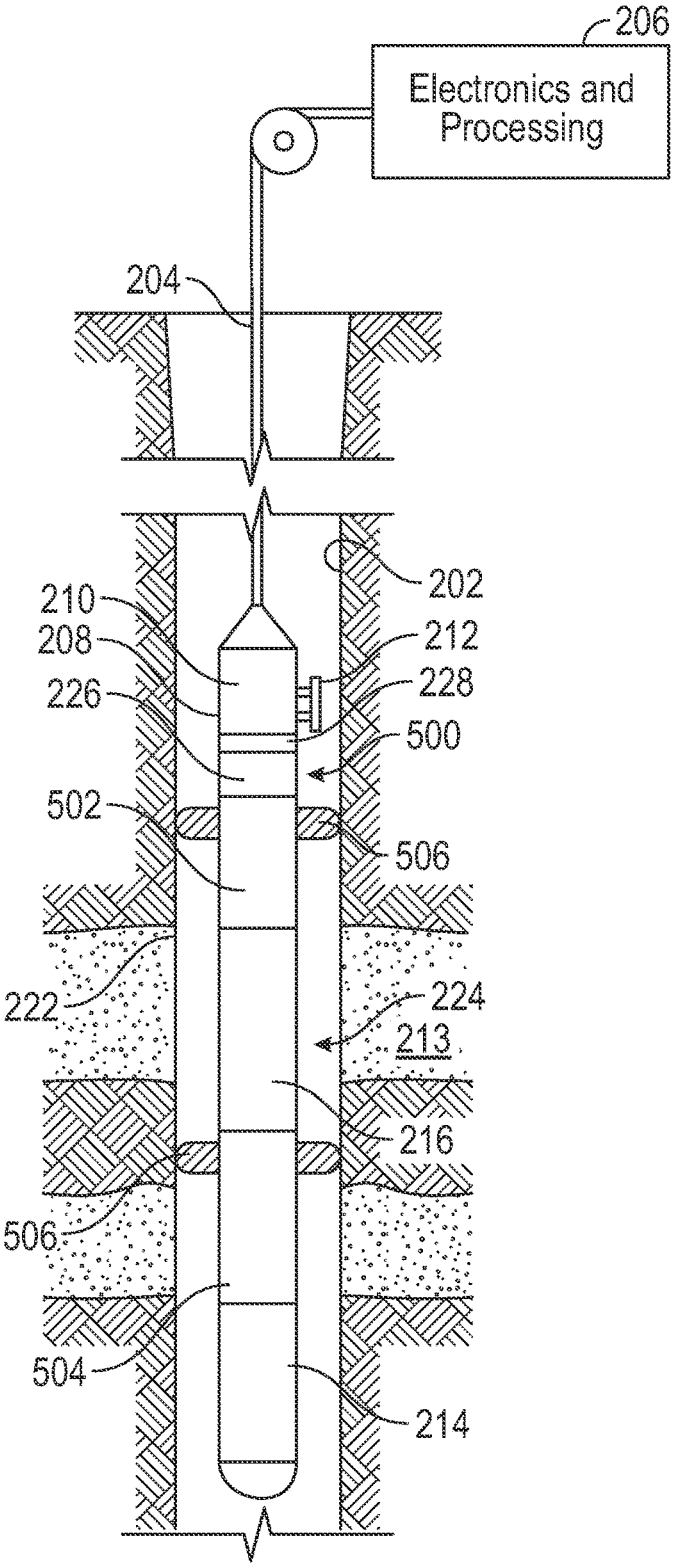
FIG. 4 is a schematic view of another embodiment of a wellsite system that may employ fracturing and sampling methods, according to aspects of the present disclosure.

FIG. 4 depicts another embodiment of a downhole tool 500 that may employ the fracturing and sampling methods described herein. The downhole tool 500 is generally similar to the downhole tool 200 discussed above with respect to FIGS. 2 and 3; however, the downhole tool employs a pair of single packer modules 502 and 504, rather than dual packer modules. Each single packer module 502 and 504 includes a packer 506 and 508 that can be employed to isolate the interval 224. The downhole tool 500 may be employed to perform the method 400 described above with respect to FIG. 4; however, rather than inflating pairs of packers, single packers may be inflated for each module 502 and 504.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

conveying a downhole tool within a wellbore, the downhole tool comprising an injection module disposed between a first packer module and a second packer module;

deploying a first packer of the first packer module and a second packer of the second packer module to isolate an interval within the wellbore;

initiating a fracture at the isolated interval by directing a fracturing fluid into the isolated interval through a port in the second packer module;

injecting a proppant into the isolated interval by directing a motive fluid into a proppant injection chamber of the injection module to displace a piston and move the proppant into the isolated interval; and performing sampling of the isolated interval by directing formation fluid from the isolated interval into the downhole tool through the port in the second packer module.

2. The method of claim 1, wherein initiating the fracture, injecting the proppant, and performing the sampling are performed at a same location within the wellbore.

3. The method of claim 1, wherein injecting the proppant comprises pumping the motive fluid into a first volume of the proppant injection chamber via a pump to displace the piston and decrease a second volume of the proppant injection chamber containing the proppant.

4. The method of claim 3, wherein initiating the fracture comprises pumping the fracturing fluid to the port in the second packer module via the pump.

5. The method of claim 1, wherein injecting the proppant comprises opening a motive fluid line valve and closing a valve to the port in the second packer module.

6. The method of claim 1, wherein performing the sampling comprises analyzing a contamination level of the formation fluid and diverting the formation fluid to a sample chamber in response detecting that the contamination level is within a desired range.

* * * * *